US005113622A

United States Patent [19]

Nishiguchi et al.

[11] Patent Number: 5,113,622

[45] Date of Patent: May 19, 1992

[54] APPARATUS FOR GRINDING SEMICONDUCTOR WAFER

[75] Inventors: Masanori Nishiguchi; Noboru Gotoh, both of Yokohama, Japan

[73] Assignee: Sumitomo Electric Industries, Ltd., Osaka, Japan

[21] Appl. No.: 747,494

[22] Filed: Aug. 19, 1991

Related U.S. Application Data

[63] Continuation of Ser. No. 496,516, Mar. 20, 1990, abandoned.

[30] Foreign Application Priority Data

| | | | |
|---|---|---|---|
| Mar. 24, 1989 | [JP] | Japan | 1-72906 |
| Apr. 10, 1989 | [JP] | Japan | 1-90386 |
| Apr. 10, 1989 | [JP] | Japan | 1-90387 |

[51] Int. Cl.[5] ..... B24B 49/00

[52] U.S. Cl. ..... 51/165.73; 51/131.1; 51/131.3; 51/131.4; 51/322

[58] Field of Search ..... 51/266, 267, 322, 165.77, 51/165.73, 131.1, 131.3, 131.4

[56] References Cited

U.S. PATENT DOCUMENTS

| | | | |
|---|---|---|---|
| 3,611,654 | 10/1971 | Weber | 51/266 X |
| 3,905,162 | 9/1975 | Lawrence | 51/322 X |
| 4,122,008 | 10/1978 | Allen | 51/267 X |
| 4,450,652 | 5/1984 | Walsh | 51/322 X |
| 4,471,579 | 9/1984 | Bovensiepen | 51/165.73 |
| 4,481,741 | 11/1984 | Bouladon | 51/322 X |
| 4,513,538 | 4/1985 | Wolters | 51/322 X |
| 4,665,658 | 5/1987 | Carcey . | |

FOREIGN PATENT DOCUMENTS

| | | | |
|---|---|---|---|
| 3429965 | 3/1985 | Fed. Rep. of Germany . | |
| 60-34266 | 2/1985 | Japan . | |
| 60-155363 | 8/1985 | Japan . | |
| 60-201868 | 10/1985 | Japan . | |
| 61-226260 | 10/1986 | Japan . | |
| 0264858 | 11/1987 | Japan | 51/131.4 |
| 63-114872 | 5/1988 | Japan . | |
| 2104809 | 3/1983 | United Kingdom . | |

*Primary Examiner*—M. Rachuba

*Attorney, Agent, or Firm*—Stevens, Davis, Miller & Mosher

[57] ABSTRACT

An apparatus is provided for grinding a semiconductor wafer, which includes a table having a work stage on which a semiconductor wafer to be ground is placed, at least the work stage being rotatable about an axis, and a grinding wheel which is movable in a direction perpendicular to or parallel to the work stage while being rotated about an axis parallel to the rotational axis of the work stage. In this apparatus, a semiconductor wafer is cooled during grinding. In order to perform cooling, the apparatus has an inlet flow path for guiding cooling liquid to a grinding surface of the grinding wheel, and an outlet flow path for collecting the cooling liquid which flows onto the work stage. The apparatus also includes a temperature detector, disposed in the outlet flow path, for detecting a temperature of the recovered cooling liquid. A rotational speed of the grinding wheel or the rotary table is controlled based on the temperature of the cooling liquid detected by the temperature detector.

23 Claims, 5 Drawing Sheets

APPARATUS FOR GRINDING SEMICONDUCTOR WAFER

This application is a continuation of application Ser. No. 496,516, filed Mar. 20, 1990.

BACKGROUND OF THE INVENTION

1. Field of the Invention

The present invention relates to an apparatus for grinding a semiconductor wafer and, more particularly, to an apparatus which cools a semiconductor wafer using cooling water during grinding.

2. Related Background Art

In a conventional grinding apparatus, a semiconductor wafer is cooled by a continuous flow of cooling water. In this case, the cooling water absorbs heat generate by grinding and is then discharged.

In particular, in a so-called back-grinding process before dicing of a GaAs semiconductor wafer, if this wafer is damaged, the yield of semiconductor device chips is decreased because circuit patterns on them are already completed.

Excessive grinding heat generated during grinding of a semiconductor wafer causes compositional deformation, grinding burn, 26 This drawback is well known in the art. It is also experienced that grinding heat is abruptly increased by abnormal grinding.

Therefore, in order to detect an abnormal grinding condition, a temperature of a wafer which is ground should be measured.

In this case, a thermocouple is brought into contact with a semiconductor wafer or is embedded in a grinding wheel to measure a temperature of the semiconductor wafer. However, it is very difficult to bring the thermocouple into contact with a semiconductor wafer. This is because a semiconductor wafer is formed of a very thin, fragile material and is ground while being rotated. Even if a thermocouple is embedded in a grinding wheel, a grinding temperature of a semiconductor wafer is indirectly measured. Therefore, a grinding temperature of the semiconductor wafer cannot be accurately measured.

SUMMARY OF THE INVENTION

It is a first object of the present invention to provide a grinding apparatus which can accurately measure a grinding temperature.

It is second object of the present invention to provide a grinding apparatus which can control the grinding conditions to prevent a semiconductor wafer from suffering from compositional deformation, grinding burns, grinding cracks, or residual stresses.

In order to achieve the above objects, according to the present invention, there is provided an apparatus for grinding a semiconductor wafer, comprising a table having a work stage on which a semiconductor wafer to be ground is placed, at least the work stage being rotated, a grinding wheel which is moved in a predetermined direction to the work stage while being rotated about an axis parallel to a rotational axis of the work stage, an inlet flow path for guiding cooling liquid to a grinding surface of the wafer, an outlet flow path for collecting the cooling liquid flowed onto the work stage, and temperature detection means, arranged in the outlet flow path, for detecting a temperature of the recovered cooling liquid.

The present invention will become more fully understood from the detailed description given hereinbelow and the accompanying drawings which are given by way of illustration only and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EBMODIMENT

A grinding apparatus for grinding a semiconductor wafer to a desired thickness before a dicing process according to an embodiment of the present invention will be described below with reference to the accompanying drawings.

Figure 1:
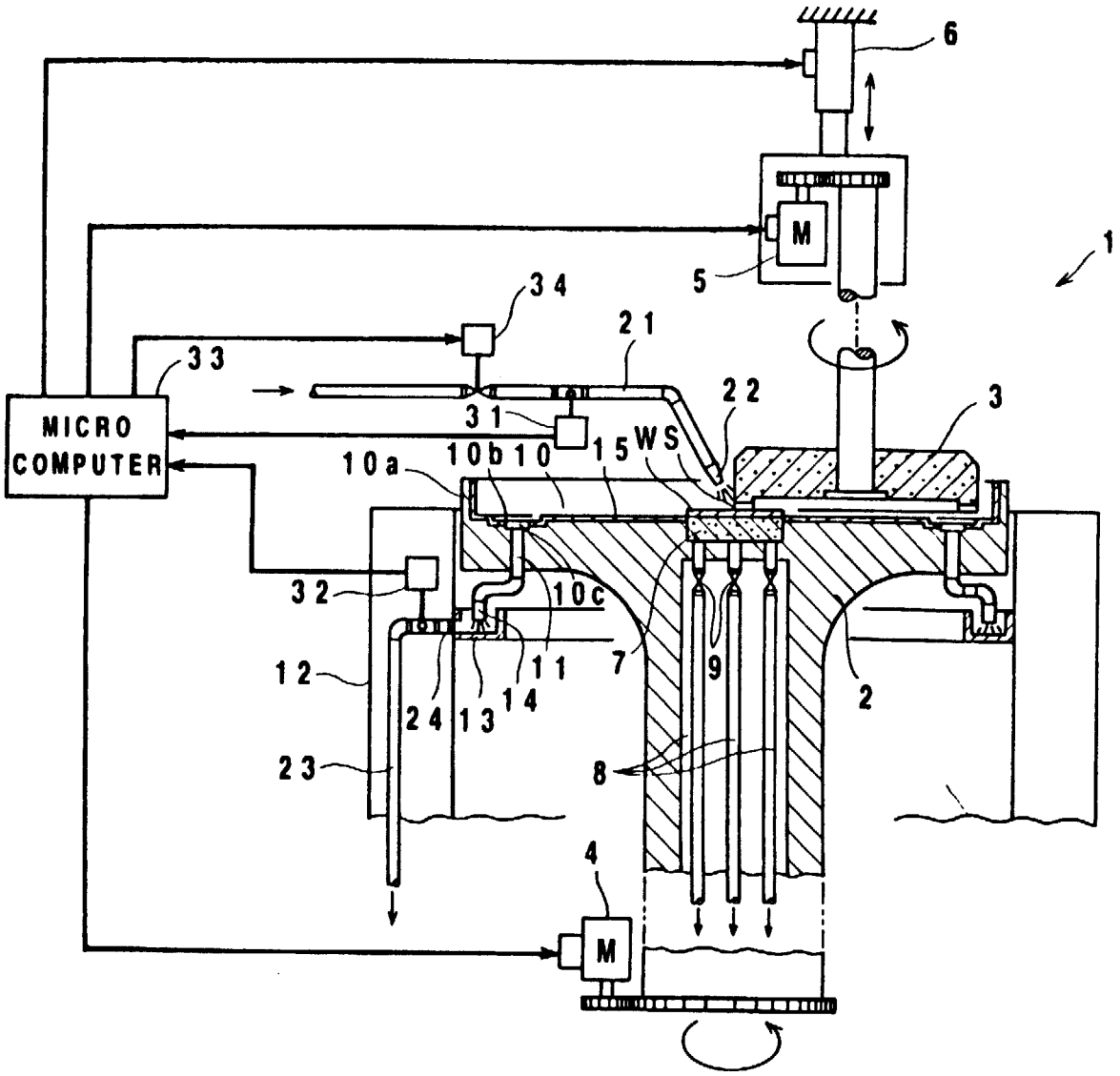
FIG. 1 is a side sectional view of a grinding apparatus for a semiconductor wafer according to a first embodiment of the present invention.

As shown in FIG. 1, a grinding apparatus 1 for a semiconductor wafer W comprises a rotary table 2 for chucking and carrying the semiconductor wafer W, and a grinding wheel 3 arranged above the table 2 for grinding the semiconductor wafer W. The rotary table 2 is rotated by a drive motor 4 while carrying the semiconductor wafer W. On the other hand, the grinding wheel 3 is rotated by a drive motor 5 and is vertically moved by an actuator 6. Therefore, the surface (for example (100) surface) of the semiconductor wafer W which is rotated slowly is evenly ground to a desired thickness by the rotating grinding wheel 3 which is gradually moved in a downward direction during grinding.

During grinding, the outer peripheral edge of the grinding wheel 3 is located at the center of the semiconductor wafer W. Thus, the grinding wheel 3 always grinds a half portion of the semiconductor wafer W. A mounting unit 7 for mounting the semiconductor wafer W is arranged at the center of the rotary table 2. The mounting unit 7 is formed of a porous ceramic. Vacuum pipes 8 are connected to the lower surface of the mounting unit 7. The semiconductor wafer W is chucked at the center of the rotary table 2 by the mounting unit 7. Each vacuum pipe 8 has a valve 9 for evenly chucking the semiconductor wafer W.

Frictional heat generated by grinding is cooled by cooling liquid (e.g., deionized water) supplied to a grinding surface S of the semiconductor wafer W which contacts the grinding wheel 3. Thus, undesired thermal influences on the semiconductor wafer W can be eliminated.

The cooling liquid is supplied from an inlet port 22 communicating with an inlet pipe 21 to the grinding surface S and absorbs grinding heat on the grinding surface S. Thereafter, the cooling liquid is caused to flow from a stage 10 of the rotary table 2 via communication flow paths 11, and is recovered in a liquid gutter 13 mounted inside a side table 12. The cooling liquid is then drained outside the apparatus via an outlet port 24 communicating with an outlet pipe 23.

More specifically, a peripheral wall 10*a* whose peripheral edge portion projects upwardly, an annular groove 10*b* formed inside the peripheral wall 10*a* along it, and a plurality of drain ports 10*c* formed in the annular groove 10*b* and communicating with the liquid gutter 13 are formed in the stage 10 of the rotary table 2. The cooling liquid flowing outwardly from the center by the centrifugal force of the rotary table 2 is blocked by the peripheral wall 10*a*, is collected in the annular groove 10*b* and is then guided from the drain ports 10*c* to the liquid gutter 13. The communication flow paths 11 for causing the drain ports 10*c* to communicate with discharge pipes 14 formed in the side surface of the rotary table 2 are formed in the rotary table 2. Note that a heat insulating layer 15 is formed on the surface of the stage 10 by a coating of vinyl chloride or the like.

The liquid gutter 13 is mounted on the side table 12 to be located between the rotary table 2 and the side table 12 which surrounds the table 2. Note that the liquid gutter 13 is formed in an annular shape, so that the shape of the liquid gutter 13 matches with a rotating pipe of the discharge pipes 14. The liquid gutter 13 is inclined so that cooling liquid is guided toward the outlet port 24.

An inlet thermometer 31 is arranged in the inlet pipe 21 communicating with the inlet port 22, and an outlet thermometer 32 is arranged in the outlet pipe 23 communicating with the outlet port 24. These inlet and outlet thermometers 31 and 32 measure entrance and exit temperatures of cooling liquid. If the inlet cooling liquid temperature is constant, only the outlet thermometer 32 be .

With this arrangement, a heat quantity produced during grinding can be obtained based on a temperature difference between the entrance and exit temperatures measured by the thermometers 31 and 32 and a flow rate of cooling liquid. The relationship between a change in heat quantity and a frequency of manufacturing defective products caused by cracks during grinding of the semiconductor wafer or warp caused by a residual stress can be numerically obtained by the monitoring of the heat quantity.

The thermometers 31 and 32 are connected to a microcomputer 33. The microcomputer 33 is connected to a cooling liquid flow control valve 34 provided to the inlet pipe 21, the drive motor 4 for rotating the grinding wheel 3, and actuator 6 for feeding the grinding wheel 3, and the drive motor 5 for rotating the rotary table 2. The drive units of these devices are individually or systematically controlled by the microcomputer 33.

When the flow control valve 34 is controlled by the microcomputer 33, the quantity of cooling liquid corresponding to a target heat quantity is calculated from the temperature difference of the two thermometers 31 and 32 supplied to the microcomputer 33. Thereafter, a degree of valve opening of the flow control valve 34 is adjusted by a control signal based on the calculation result, i.e., a flow rate of cooling liquid is adjusted. Similarly, in an apparatus using only the outlet thermometer 32, the quantity of cooling liquid corresponding to a target heat quantity is calculated from the gradient of an ascending curve of the heat quantity, and a flow rate of cooling liquid is adjusted by a control signal based on the calculation result.

When the drive motor 4 of the grinding wheel 3 is to be controlled by the microcomputer 33, a rotational speed of the grinding wheel 3 corresponding to the target heat quantity is calculated from the temperature difference of the two thermometers 31 and 32. The rotational speed of the drive motor 4 is controlled by a control signal based on the calculation result.

Similarly, when the actuator 6 of the grinding wheel 3 is to be controlled, a feed speed of the grinding wheel 3 corresponding to the target heat quantity is calculated, and is controlled by a control signal based on the calculation result. When the drive motor 5 of the rotary table 2 is to be controlled, a rotational speed of the rotary table 2 corresponding to the target heat quantity is calculated, and is controlled by a control signal based on the calculation result.

In this manner, since the respective devices are feedback-controlled by the microcomputer 33, grinding can be performed at a constant temperature.

When the outlet thermometer 32 detects an abrupt increase in temperature, an alarm may be generated regardless of the above-mentioned control. In this case, it can be considered that some abnormal grinding has occurred, and an operator must quickly take a countermeasure against it.

In this embodiment, a system for vertically feeding the grinding wheel 3 has been described. In a system for horizontally feeding the wheel 3, a horizontal feed speed of the actuator 6 is controlled.

Figure 2:
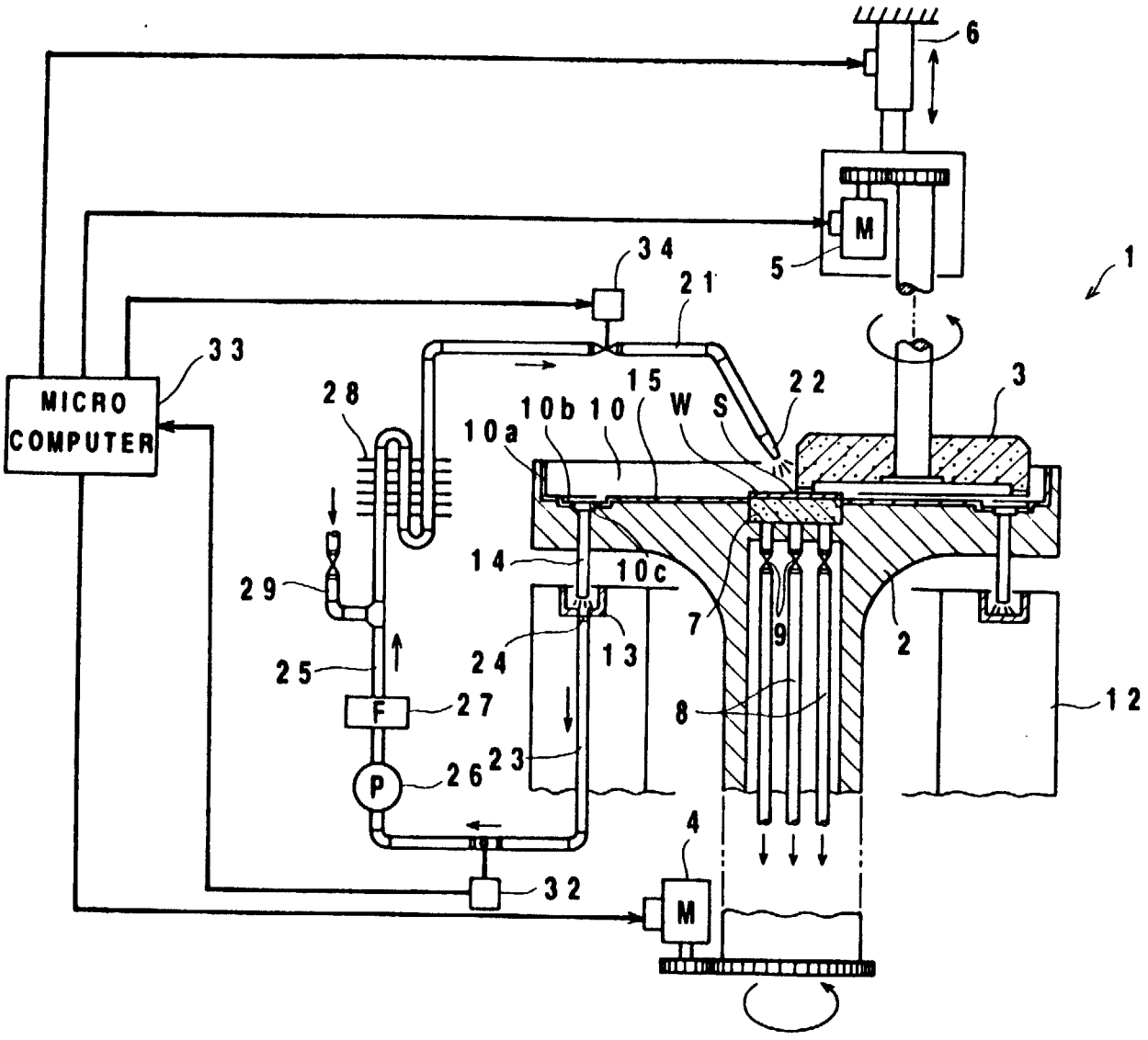
FIG. 2 is a side sectional view of a grinding apparatus for a semiconductor wafer according to the second embodiment of the present invention.

The second embodiment of the present invention will be described below with reference to FIG. 2.

The characteristic features of this embodiment are that an upstream side portion of an inlet pipe 21 communicating with an inlet port 22 communicates with a downstream side portion of an outlet pipe 23 communicating with an outlet port 24 through a circulating flow path 25, and that an outlet thermometer 32, a liquid pump 26, a filter 27, and a radiator (heat exchanger) 28 are arranged midway along the circulating flow path 25.

Cooling liquid is supplied along the circulating flow path 25 under pressure by the liquid pump 26. In this case, ground chips in the cooling liquid are removed by the filter 27, and the cooling liquid is then cooled by the radiator 28. Thereafter, the cooled liquid is supplied from the inlet port 22 to a grinding surface S. The cooling liquid which absorbs grinding heat on the grinding surface S is collected in the circulating flow path 25 via a liquid gutter 13. After the temperature of cooling liquid is measured by the outlet thermometer 31, the cooling liquid is returned to the liquid pump 26. A liquid replenishing pipe 29 is connected in a portion of the circulating flow path 25 between the filter 27 and the liquid pump 26, so that cooling liquid is replenished from the replenishing pipe 29 to the circulating flow pipe 25.

The temperature of cooling liquid measured by the outlet thermometer 32 is gradually increased from the beginning of grinding, and reaches a steady temperature after the lapse of a predetermined period of time. Therefore, the relationship between an increase or the gradient of an ascending curve of a temperature of cooling liquid and a frequency of manufacturing defective semiconductor wafers W can be numerically obtained with reference to a temperature indicated by the outlet thermometer 32 in the steady state.

In the steady state, the following relationship can be basically established.

Grinding Heat = Heat Quantity Discharged Outside System

More specifically, when a temperature of cooling liquid is kept constant, this means that absorbed heat is balanced with discharged heat. In this case, a heat absorption factor is grinding heat, and a heat discharging factor is mainly heat discharged from the circulating flow path 25 into air. Therefore, if a heat quantity discharged from the circulating flow path 25 into air can be calculated, grinding heat in the steady state can be obtained. The heat quantity discharged from the circulating flow path 25 into air can be estimated from a capacity of the radiator 28.

Therefore, according to this embodiment, the above-mentioned devices are controlled by a microcomputer 33.

Figure 3:
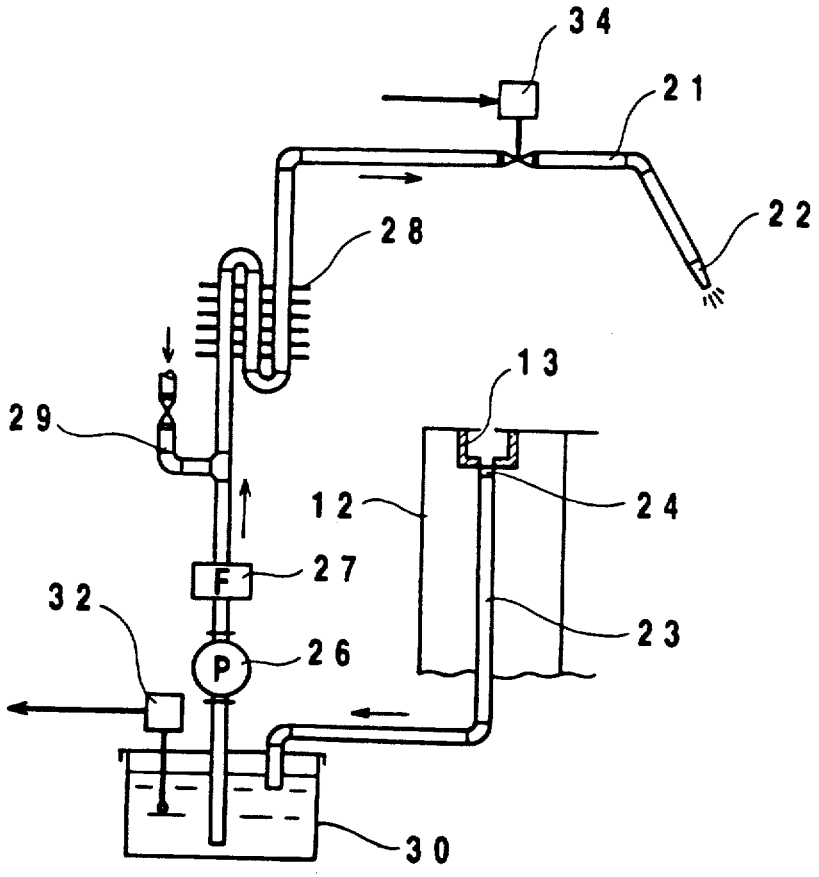
FIG. 3 is a partial side view showing a modification of the second embodiment.

FIG. 3 shows a modification of the second embodiment. In this modification, a cooling liquid tank 30 is arranged at the downstream side of the liquid pump 26. With this arrangement, recovered cooling liquid is stored in the cooling liquid tank 30, so that temperature measurement by the outlet thermometer 32 and supply of cooling liquid under pressure by the liquid pump 26 can be very smoothly performed.

The third embodiment of the present invention will be described below with reference to FIG. 4.

In this embodiment, cooling liquid supplied from an inlet port 22 to a grinding surface S absorbs grinding heat on the grinding surface S, and is then caused to flow from a rotary table 2 to a side table 16 surrounding the rotary table 2. The cooling liquid which has flowed into the side table 16 is drained outside an apparatus from a liquid gutter 13 mounted on an outer wall 16*a* of the side table 16.

More specifically, a collar-like drip-proof cover 17 formed of rubber extends between the rotary table 2 and the side table 16. The drip-proof cover 17 is brought into tight contact with and fixed to the rotary table 2. Therefore, cooling liquid discharged onto the rotary table 2 is caused to flow smoothly toward the side table 16 by the centrifugal force of the rotary table 2 without dripping into a gap between the two tables 2 and 16. An inclined surface 16*b* is formed on the upper surface of the side table 16, so that cooling liquid which has flowed from the rotary table 2 is guided outwardly. Furthermore, the liquid gutter 13 is mounted on the outer wall 16*a* of the side table 16 so as to surround the side table 16. The liquid gutter 13 is obliquely mounted so that cooling liquid is guided toward an outlet port 24.

An inlet thermometer 31 is provided to a portion of an inlet pipe 21 on the upstream side of the inlet port 22, and an outlet thermometer 32 is provided to a portion of an outlet pipe 23 on the downstream side of the outlet port 24. Entrance and exit temperatures are measured by the two thermometers 31 and 32.

With the above arrangement, grinding heat can be measured from a temperature difference between entrance and exit temperatures of cooling liquid and a flow rate of cooling liquid. Control operations of the microcomputer 33 of the first embodiment can be performed based on the grinding heat.

Figure 4:
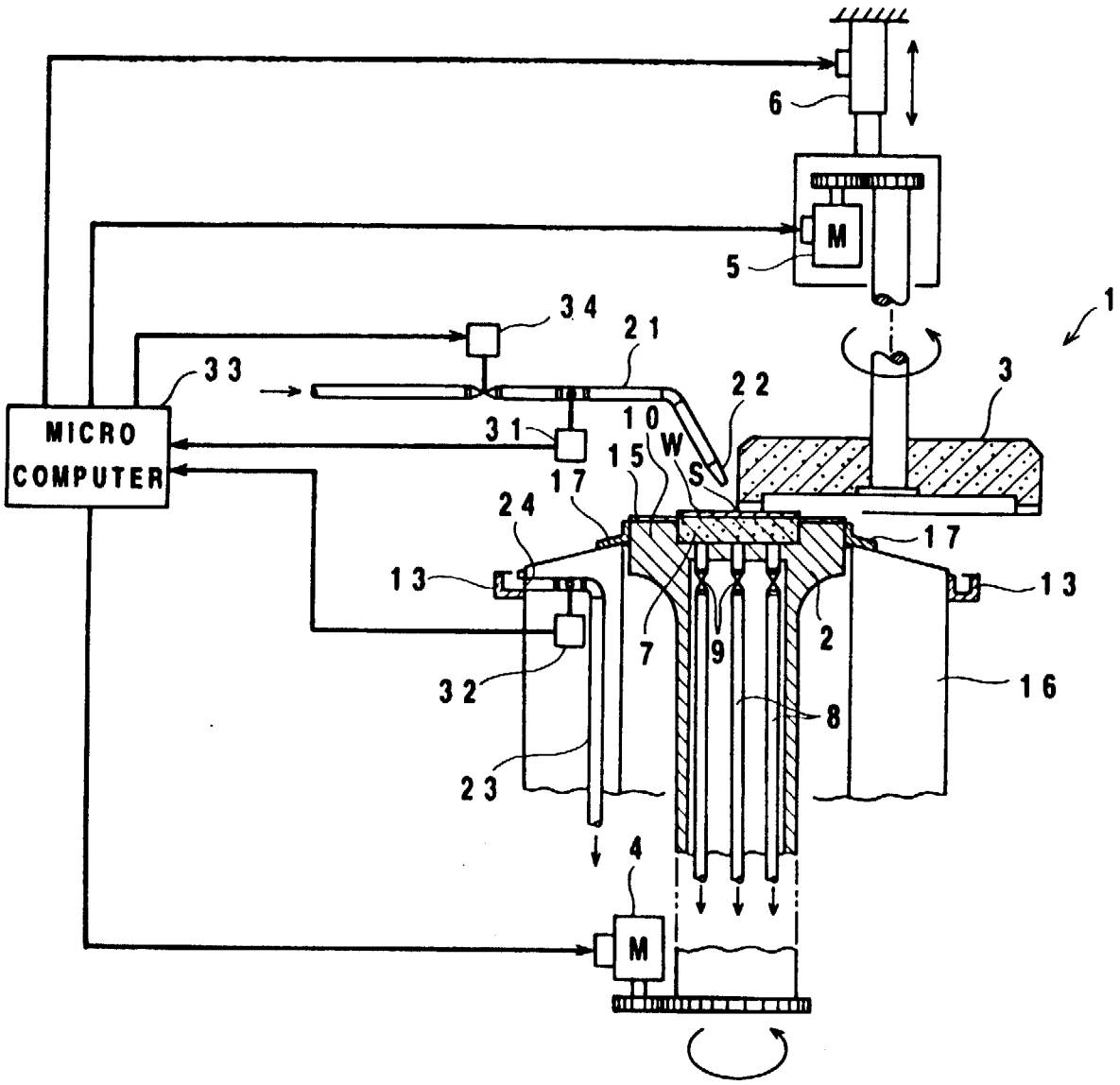
FIG. 4 is a side view of a grinding apparatus for a semiconductor wafer according to a third embodiment of the present invention.
Figure 5:
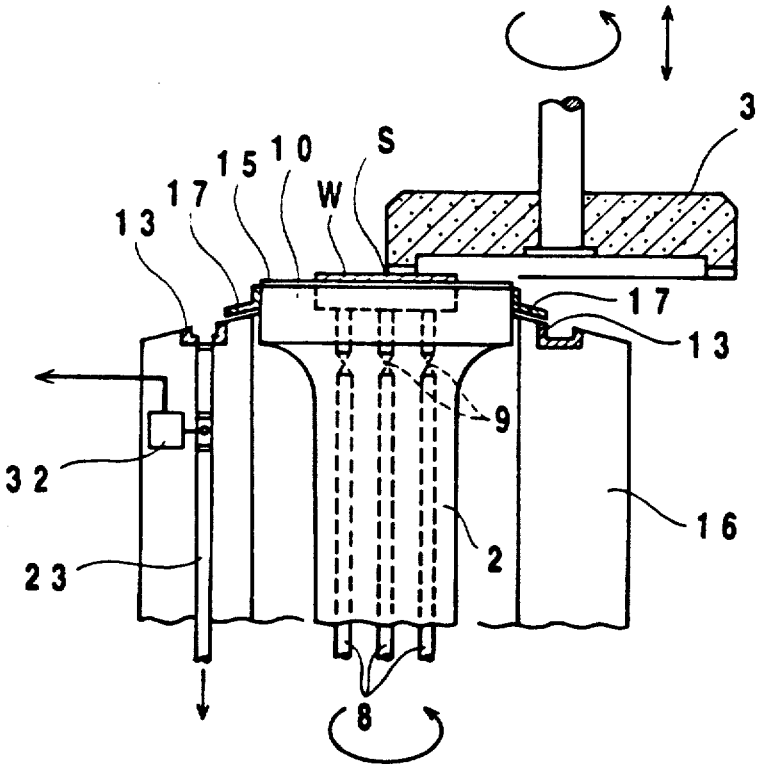
FIG. 5 is a partial side view showing a modification of the third embodiment.

FIG. 5 shows a modification of FIG. 4. In this modification, the liquid gutter 13 is provided on the upper surface of the side table 16 at a position adjacent to the drip-proof cover 17. In this manner, natural heat radiation of cooling liquid after heat absorption can be eliminated, and the temperature of the cooling liquid can be more precisely measured.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for grinding a semiconductor wafer, comprising:

a rotary table having a work stage capable of rotating about a rotation axis;

a grinding wheel which is movable in a predetermined direction relative to said work stage while being rotated about an axis parallel to said rotation axis of said work stage;

an inlet flow path for guiding cooling liquid directly on to a grinding surface of said grinding wheel;

an outlet flow path for collecting cooling liquid which flows onto said work stage from said grinding wheel; and first and second temperature detecting means, disposed respectively in said outlet flow path and said inlet flow path, for detecting a temperature of the cooling liquid in said outlet flow path and said inlet flow path;

circulation enabling means for enabling fluid communication between an upstream side portion of said inlet flow path and a downstream portion of said outlet flow path to circulate said cooling liquid between said inlet flow path and said outlet flow path; and flow control means disposed in said circulation means, for controlling a flow rate of said cooling liquid based on said temperatures detected by said first and second temperature detection means.

2. An apparatus according to claim 1, wherein a liquid pump is disposed in said circulating flow path.

3. An apparatus according to claim 1, wherein a filter is disposed in said circulating flow path.

4. An apparatus according to claim 1, wherein a heat exchanger or a radiator is disposed in said circulating flow path.

5. An apparatus according to claim 1, wherein a cooling liquid tank is provided in said circulating flow path.

6. An apparatus according to claim 1, further comprising control means for determining a control amount of at least one of a flow rate of the cooling liquid, a rotational speed of said grinding wheel, a moving speed of said grinding wheel, and a rotational speed of said work stage.

7. An apparatus according to claim 1, further comprising a flow control valve disposed in said inlet flow path, and wherein said control means comprises a microcomputer for controlling said flow control valve to control the flow rate of the cooling liquid.

8. An apparatus according to claim 6, wherein said control means comprises a microcomputer for controlling the rotational speed of said grinding wheel.

9. An apparatus according to claim 6, wherein said control means comprises a microcomputer for controlling the moving speed of said grinding wheel.

10. An apparatus according to claim 6, wherein said control means comprises a microcomputer for controlling the rotational speed of said work stage.

11. An apparatus according to claim 1, further comprising cooling liquid collecting means arranged around said work stage for collecting said cooling liquid.

12. An apparatus according to claim 11, wherein said cooling liquid collecting means comprises:

a peripheral wall formed by projecting a peripheral edge portion of said work stage upward;

a communication flow path to enable communication between an inner stage of said peripheral wall and a discharge port formed in a side surface of said table; and a liquid gutter arranged along a rotational pipe of said discharge port.

13. An apparatus according to claim 11, wherein said cooling liquid collecting means comprises:

a collar-like drip-proof cover surrounding said table; and a liquid gutter for collecting the cooling liquid guided outside said table by said drip-proof cover.

14. An apparatus according to claim 12, wherein said liquid gutter is mounted on a side table arranged to surround said table.

15. An apparatus according to claim 13, wherein said liquid gutter is mounted on a side table arranged to surround said table.

16. An apparatus as in claim 11, wherein said cooling liquid collecting means comprises:

a side table positioned to surround said rotary table;

a drip-proof collar fixed to said rotary table and having a portion extending to cover a gap between said rotary table and said side table, said side table having an inclined upper surface; and a gutter mounted on said table to surround said rotary table and positioned to receive cooling liquid flowing from said rotary table on to said table, said gutter having an oblique orientation to guide the cooling liquid to an outlet port disposed at a lowest elevation of said gutter;

whereby cooling liquid discharged onto said rotary table flows towards said side table due to centrifugal forces of said rotary table.

17. The apparatus as in claim 16, wherein said gutter is mounted on an outer wall of said side table and wherein said cooling liquid flows along said inclined upper surface of said side table to said gutter due to gravitational forces.

18. The apparatus as in claim 17, wherein said portion of said collar which extends to cover said gap is oriented parallel to said inclined upper surface of said side table.

19. The apparatus as in claim 18, wherein said collar is made of rubber.

20. The apparatus as in claim 16, wherein said gutter is mounted on said inclined upper surface of said side table.

21. The apparatus as in claim 20, wherein said portion of said collar which extends to cover said gap is oriented parallel to said inclined upper surface of said side table.

22. The apparatus as in claim 21, wherein said collar is made of rubber.

23. The apparatus as in claim 20, wherein said gutter is positioned adjacent to and below said collar.

* * * * *